US006363943B1

(12) United States Patent
Jenkins et al.

(10) Patent No.: US 6,363,943 B1
(45) Date of Patent: Apr. 2, 2002

(54) CHILD'S NAIL PAINTING TOY

(75) Inventors: Nevin C. Jenkins, Homosasssa; Antonio Lebron, Spring Hill, both of FL (US)

(73) Assignee: Fashion Nails, Inc., Homosassa, FL (US)

( * ) Notice: Subject to any disclaimer, the term of this patent is extended or adjusted under 35 U.S.C. 154(b) by 0 days.

(21) Appl. No.: 09/777,617

(22) Filed: Feb. 6, 2001

(51) Int. Cl.[7] ..... A45D 29/00; A45D 29/18

(52) U.S. Cl. ..... 132/73; 132/73.5

(58) Field of Search ..... 132/73, 73.5, 75.5, 132/285, 319; 446/475, 296, 26; 101/33, 41, 166, 193, DIG. 40

(56) References Cited

U.S. PATENT DOCUMENTS 5,960,798 A * 10/1999 Jenkins et al. ..... 132/73
6,029,673 A * 2/2000 Jenkins et al. ..... 132/73
6,155,271 A * 12/2000 Sussman ..... 132/200
6,206,009 B1 * 3/2001 Paxson ..... 132/73

* cited by examiner

*Primary Examiner*—John J. Wilson
*Assistant Examiner*—Robyn Kieu Doan
(74) *Attorney, Agent, or Firm*—Martin Fleit; Paul Bianco

(57) ABSTRACT

A method for applying nail paint to a finger or toe nail in which a positive image Is established in a cutout defined on a plate. Nail paint is applied to the cutout to create a negative representation of the negative image in nail paint. The representation of the image in nail paint is picked up and transferred onto a nail of a person. The picked up representation is rotated through one revolution during the transfer.

17 Claims, 11 Drawing Sheets

CHILD'S NAIL PAINTING TOY

BACKGROUND OF THE INVENTION

1. Field of Invention

The present invention relates to a method and apparatus for use as a child's nail painting toy.

2. Prior Art

Various products have been advanced for painting finger or toe nails, but all are difficult to use and require a certain degree of manual dexterity. There remains a need for a toy for this purpose that is very easy to use by a child.

SUMMARY OF THE INVENTION

According to the present invention, a novel apparatus and method is provided that enables children to paint their finger nails or toe nails quite easily. The foregoing is accomplished by a novel apparatus that consists of a stand that holds a series of plates. Each plate is formed with a plurality of images as cutouts. This may be accomplished by any known engraving, stamping or molding process. One of the plates is located in an operative position on the stand, and a pivotal arm, carrying a pad print head and a squeegee, pivots from a starting position, toward the plate to pickup an image, and then reverses toward a depositing position where a child has a digit, finger or toe located in an orientation to receive the deposit of the print head. By a simple swiveling of the pivot arm, to and from, an image is transferred from the plate to the finger or toe nail. Nail paint is deposited on or just in advance of the cutout image of the plate prior to the swiveling motion; during pivot of the arm toward the plate, excess paint is squeegeed off and the replica of the image in the form of the paint is picked up and transferred to the finger or toe. By repeating the steps noted above, it is possible to recreate multi-color images of rather complex design, using for each deposit, a new image on the plate. To this end, the plate is provided with a way to index between each image pickup.

Other and further details of the method and apparatus of the present invention will become clearer from the following detailed description of a preferred embodiment of the invention when taken with the appended drawings.

DETAILED DESCRIPTION OF PREFERRED EMBODIMENT

Figure 1:
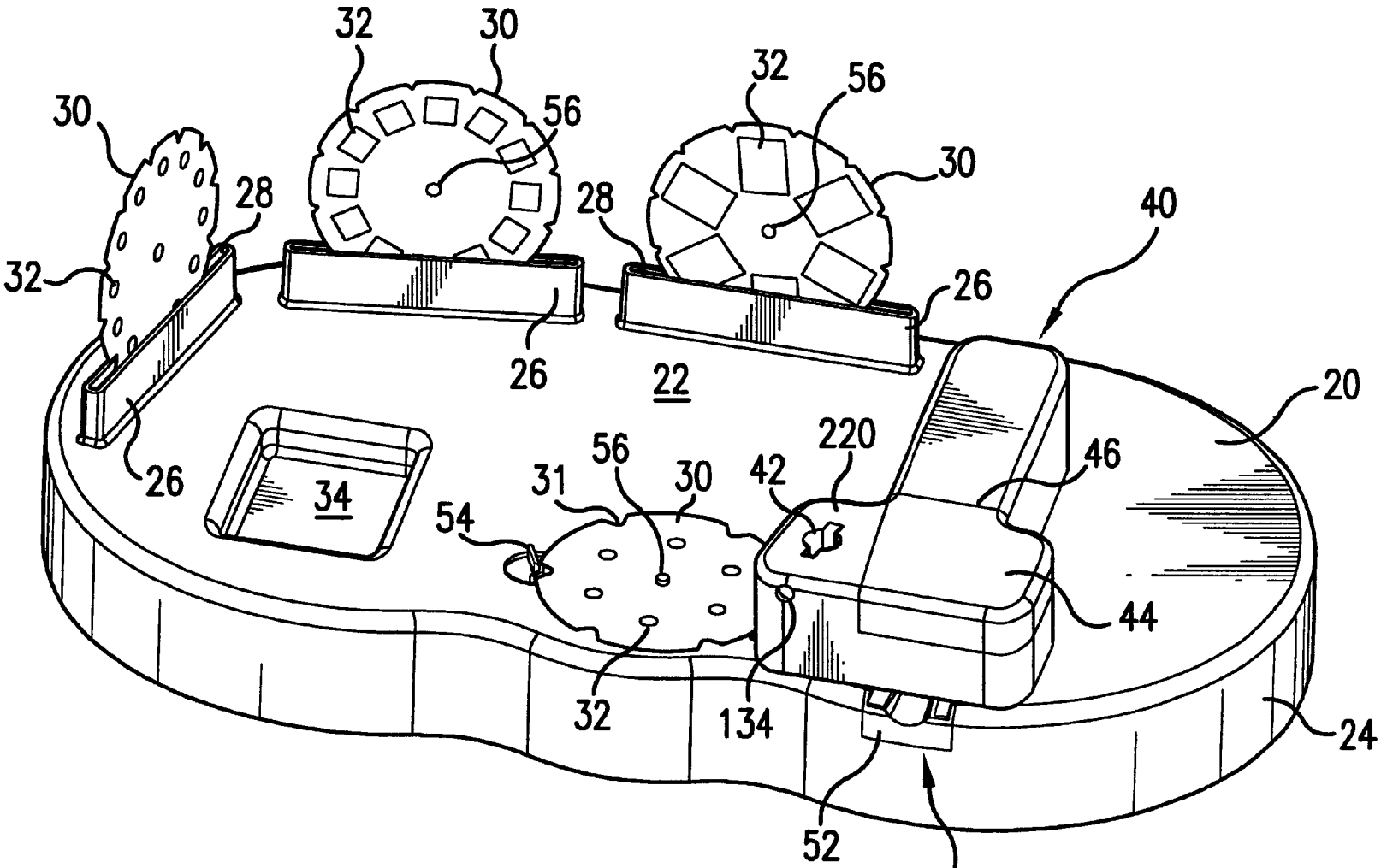
FIG. 1 shows in perspective the novel toy of the present invention.
Figure 8:
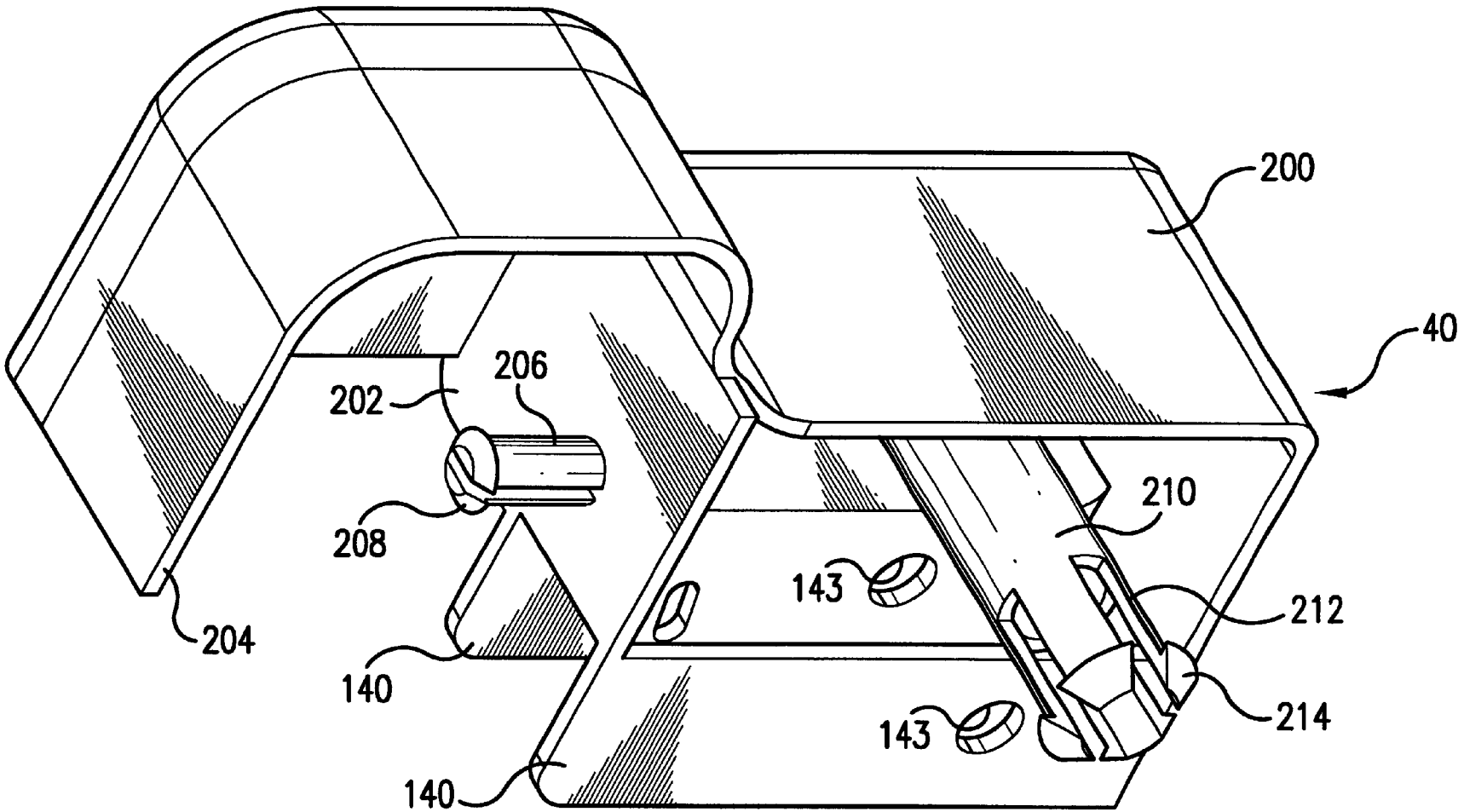
FIG. 8 is a perspective view of the underside of the shell that forms the swing arm.
Figure 9:
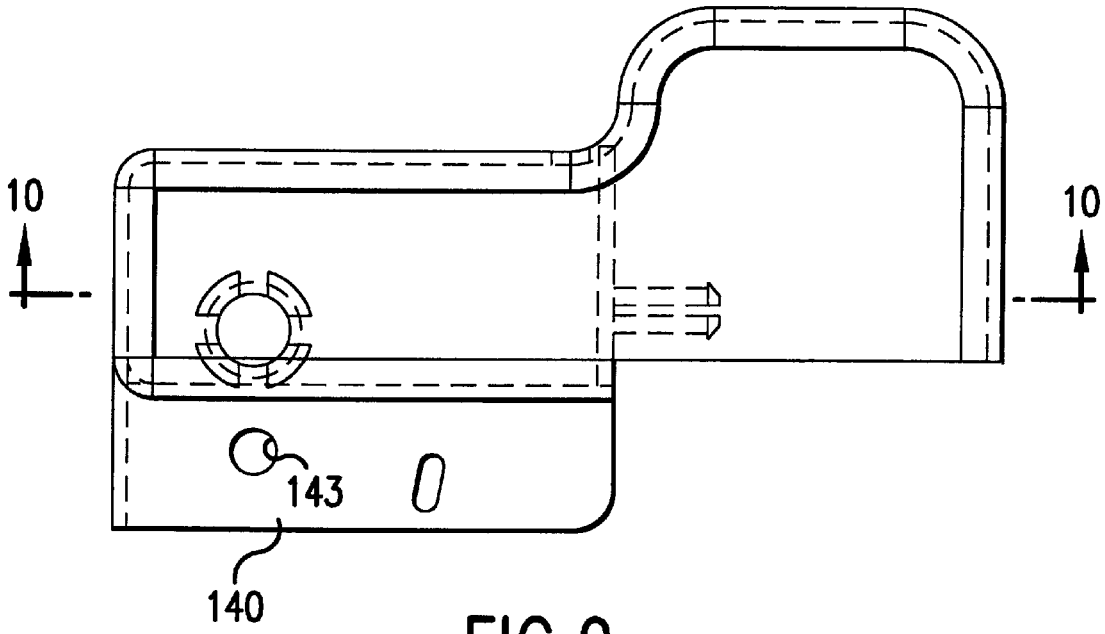
FIG. 9 is a top view of the shell shown in FIG. 8.
Figure 10:
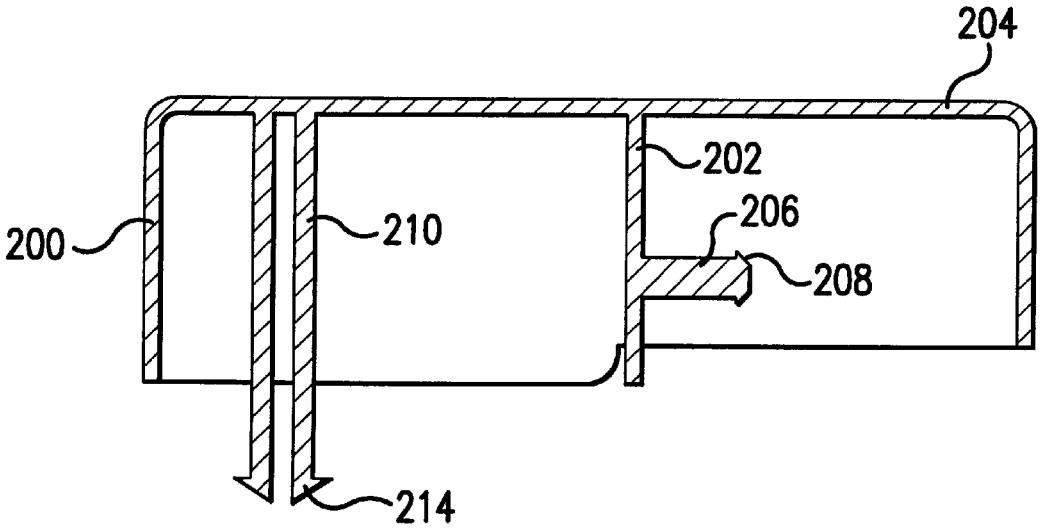
FIG. 10 is a section of FIG. 9 taken along line 10—10.

Referring initially to FIG. 1, shown is a stand 20 of essentially oval in shape but having aspects of free form. The stand 20 is molded as a shell out of plastic and consists of a top platform 22 having a depending skirt 24 all around holding the platform 22 off any suitable supporting surface, such as, a table. At one end of platform 22 and along the back edge are stands 26 which provide vertical slots 28 in which plates 30 containing cutout images 32 in one surface can be vertically stood. Three such plates 30 are shown. Also, at the same end of platform 22 is a well 34 molded into platform 22, which serves to hold bottles of nail paint. Toward the other end of the platform 22 is a pivotal arm 40 including a squeegee and a print head. The squeegee 42 can be partially seen but the print head lies beneath a hinged cover 44 which can be lifted to access the print head for cleaning or other purposes. The hinge line 46 is shown in FIG. 1. The arm 40 is also a shell molded out of plastic, see FIGS. 8–10, and consists of a main portion 200 provided with a baffle 202 that separates out the print head portion 204. Projecting from the baffle 202 horizontally is a split shaft 206 provided with an enlarged rim 208 at its free end. The pinion 66 has a recess that receives the shaft 206 and it is held in place by the rim 208. A main supporting shaft 210 extends vertically from the underside of the top surface of arm 40 that has a split lower end 212 that terminates in an enlarged rim 214. By this arrangement, shaft 210 can be inserted through a hole in the platform 22 for a pivotal mounting. The remaining structure shown in FIGS. 8–10 relates to other aspects of the invention and will be discussed in the following.

The arm 40 pivots between two positions, one just above a finger or toe holding position 50 consisting of an indentation in the platform 22 which allows the finger or toe to lie with the nail just even with the surface of the platform 22 to enable clearance of the arm 40. In the most preferred form, the indentation is established by a block 52 defining a V shaped upper surface that serves to hold the digit positioned in the indentation most securely without movement. The other position appears in FIG. 1 just to the left, and is where a plate 30 is located in a horizontal orientation. Plate 30 has notches 31 in its periphery which cooperate with a biased detent 54 to assure the indexing of plate 30. Plate 30 is positioned on a turntable or is provided with an axle to enable the plate 30 to rotate about its center 56. As shown in FIG. 1, plate 30 is provided with six cutout images 32. The arm 40 pivots to the left, as shown in FIG. 1, where it overlies the cutout image on plate 30 nearest the depositing position. During movement of the arm 40 toward the plate 30, the squeegee 42 leads and will wipe excess nail paint off the active cutout image preparing it for pickup. The pickup head next arrives over the squeegeed cutout image, and picks up the nail paint image defined by the active cutout. The arm now reverses and pivots toward the deposit position, toward the right as shown in FIG. 1, eventually arriving at the deposit position whereupon the picked-up image in the form of nail paint is deposited on the finger or toe nail.

A complete design may comprise a plurality of colors. In order to recreate the image on a finger nail, each color portion must be recreated separately. Therefore, the images on the plate 30 can consist of consecutive images, each representing one of the color portions. Thus, the images can be deposited in a serial manner onto a finger nail using the cutout images of the plate and using the appropriate color for each image, thereby recreating a complex multi-color design.

Figure 2:
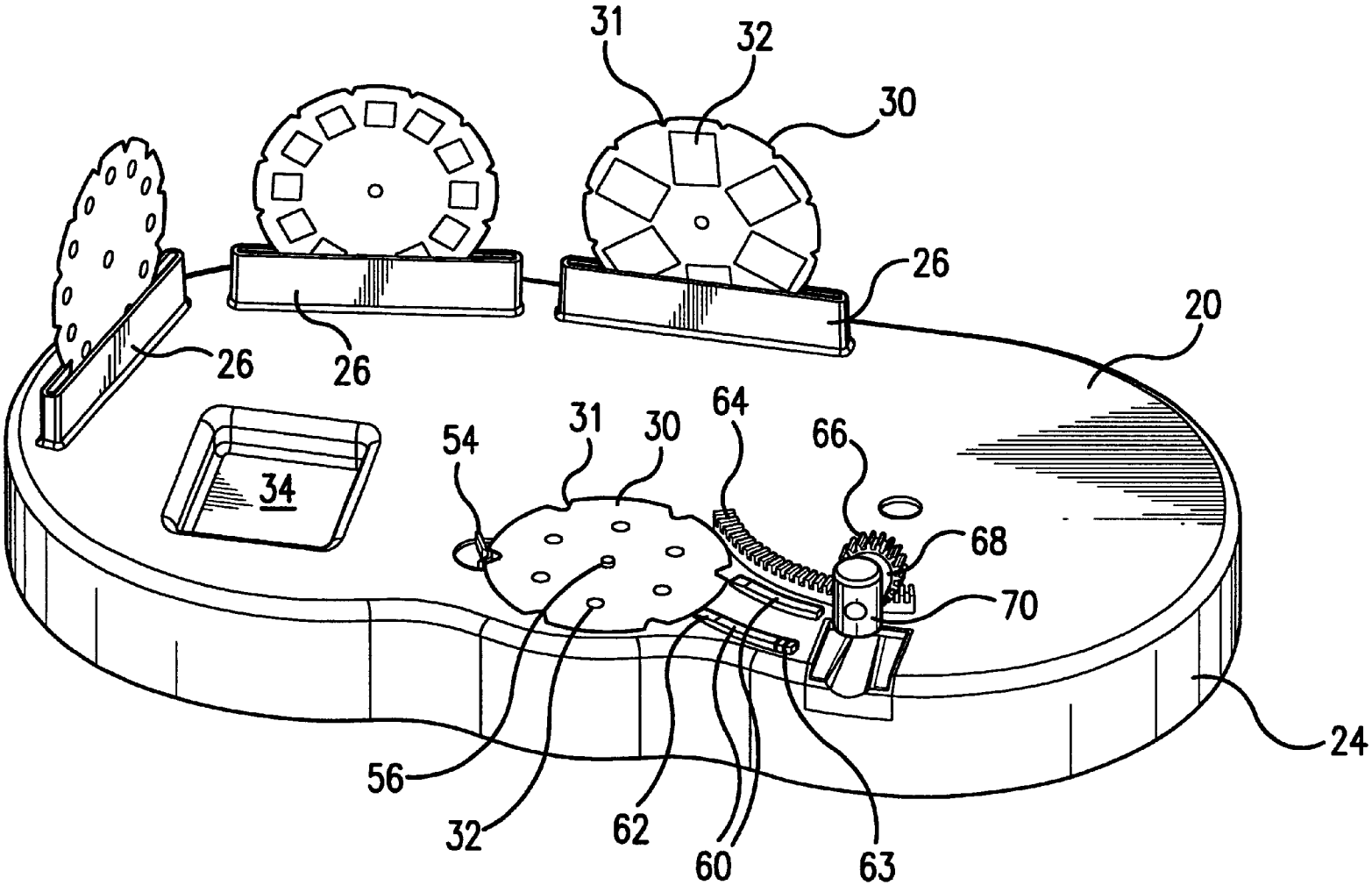
FIG. 2 is a perspective like FIG. 1 that shows the toy with the pivot arm omitted in order to show the detail of the controlled pivotal motion.
Figure 5:
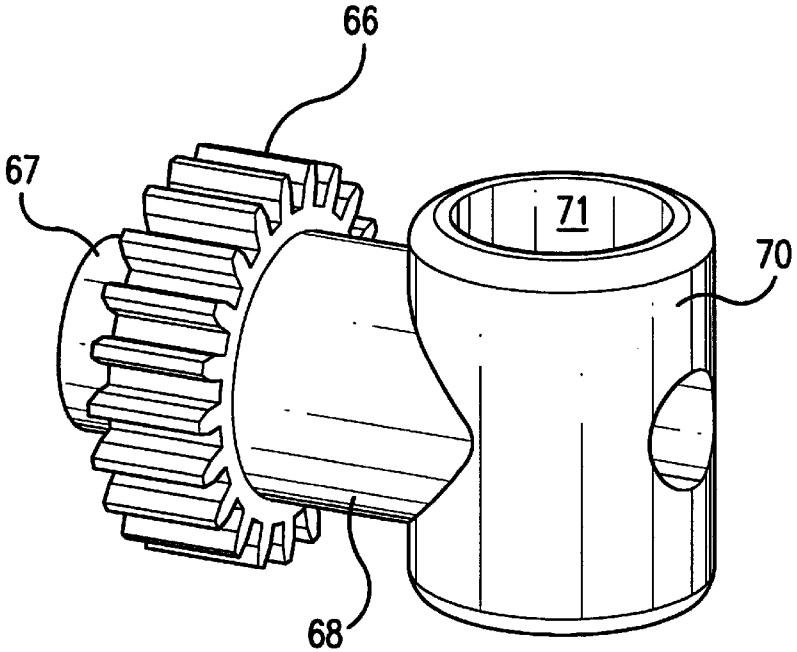
FIG. 5 is an assembled view of the print head with the pad omitted.

The unique mechanism employed in the present invention can be seen in FIGS. 2 and 5. Shown is a pair of rails 60 for carrying the squeegee between the two operative positions. Rails 60 are provided with ramps 62 for lifting the squeegee up as it leaves the plate 30. At the other end of the rails, a stop may be provided, which can take the form of a notch 63 in one of the rails 60, but any form is suitable. An arcuate rack 64 is provided that extends from and between the pickup position to the deposit position. Riding on the rack 60 is a pinion 66 that is freely rotatable on a shaft 67(206) fixed into the housing of the arm 40. Hence, the pinion 66 will rotate as the arm 40 is pivoted along the rack 60. Fixed to the pinion 66 by a short shaft 68 is a print head 70 having a resilient pickup pad of suitable material, such as silicone, (not shown) press or friction fitted into a recess 71 provided at one end. The construction and arrangement is such that when the print head 70 is over the cutout image of the plate 30, it will be vertical and will be engaging the positive cutout image with slight pressure. In other word, the print head will just kiss the plate 30 and the positive cutout image to pickup the negative finger nail paint representation of the positive cutout image. When the print head 70 is directly over the deposit position, that is over the finger nail, the print head 70 will have made exactly one revolution or turn, and again be vertical, just kissing the finger nail with the appropriate pressure to transfer the negative finger nail paint representation as a positive image on the finger nail. As noted, during transit from the plate 30 to the finger, the print head 70 will be rotating, making exactly one revolution.

Figure 3:
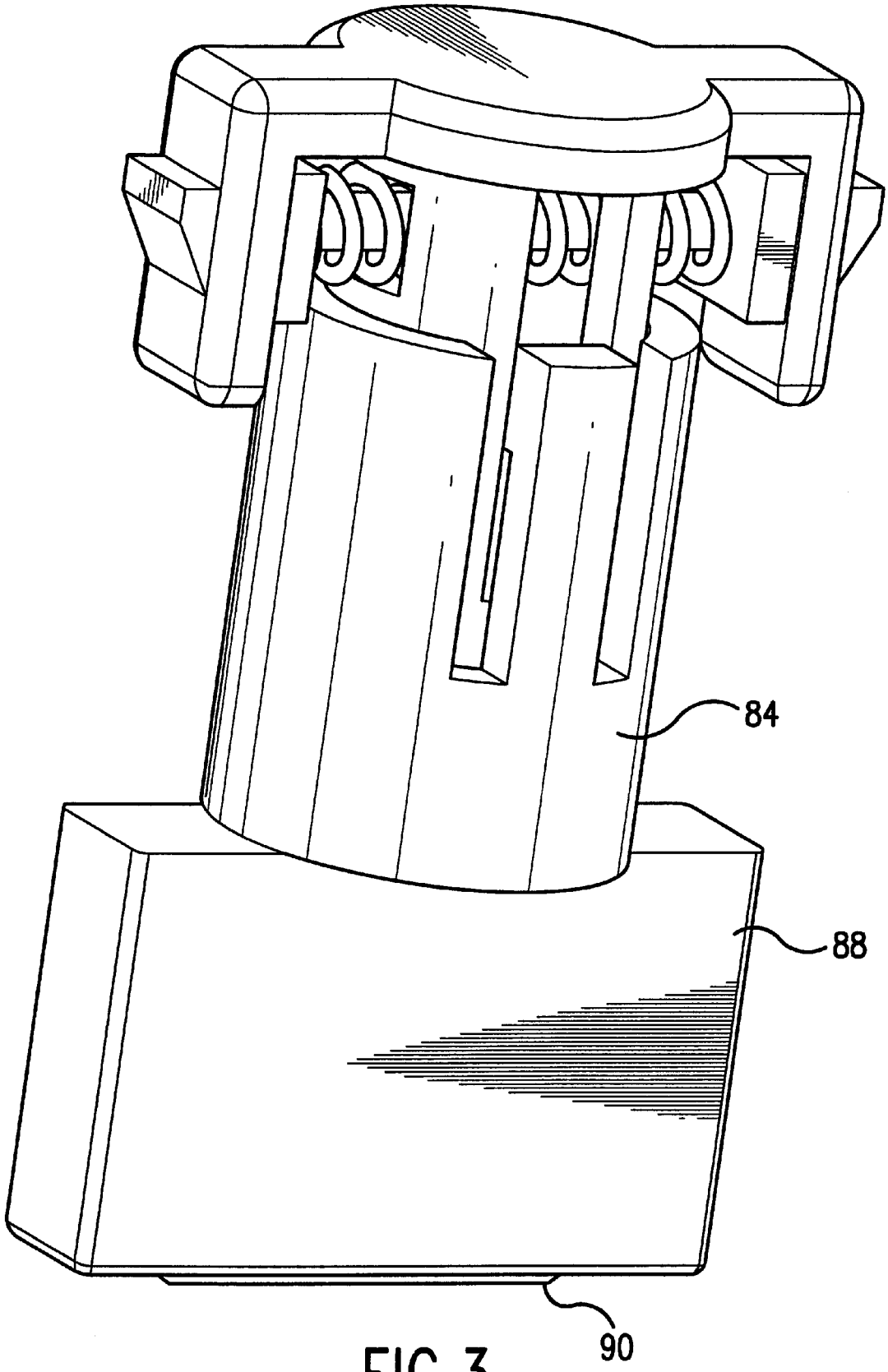
FIG. 3 is an assembled view of the squeegee.
Figure 4:
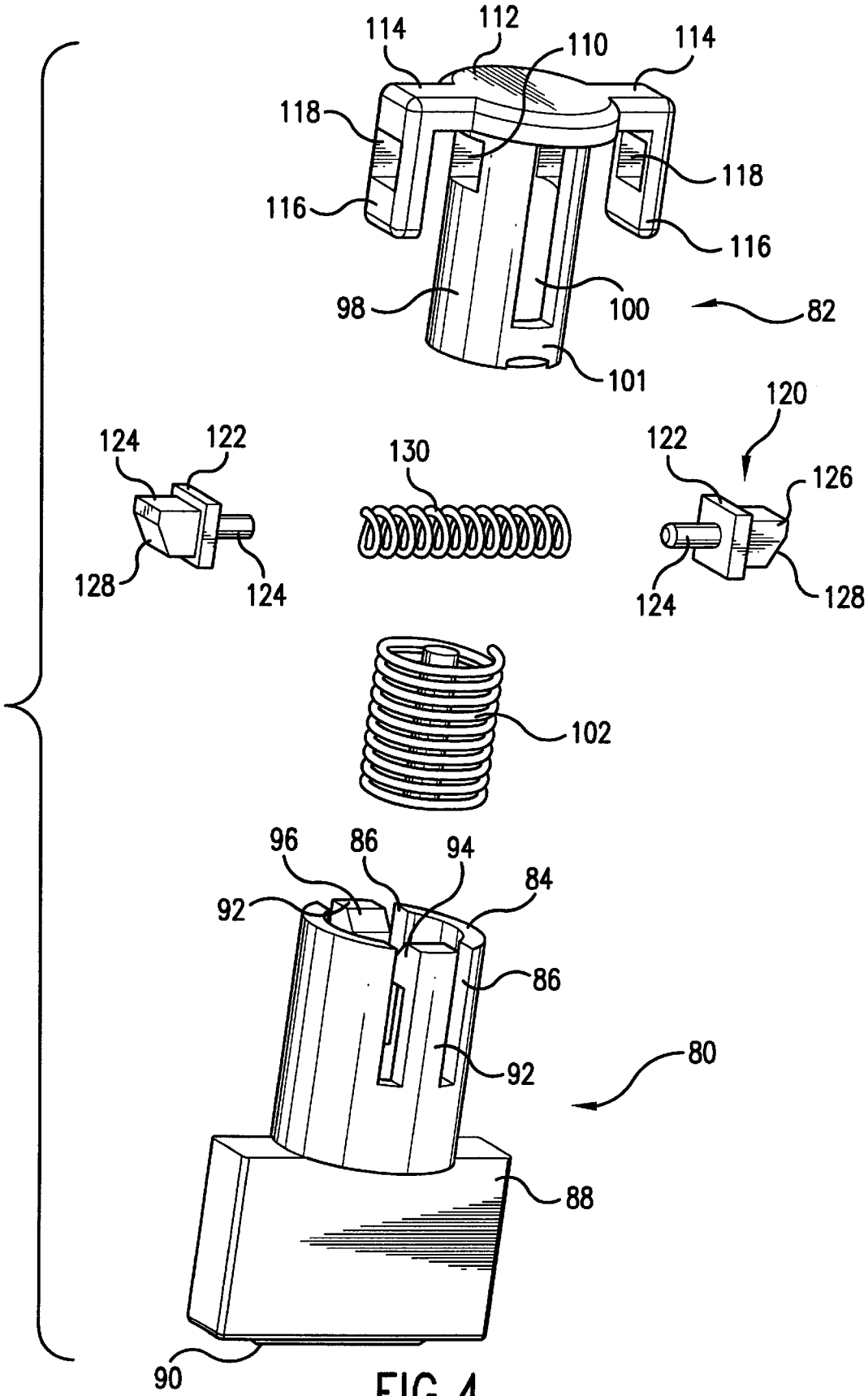
FIG. 4 is an exploded view of the squeegee.

The details of the squeegee are shown in FIGS. 3 and 4. As will be evident from the exploded view of FIG. 4, the squeegee consists of a lower part 80 that telescopes with an upper part 82. Lower part 80 consists of a top cylindrical portion 84 provided with four vertical slots 86. Integral with the bottom of lower part 80 is a blade holding block 88 into which is encapsulated a doctor blade 90, or other suitable blade, that projects out of the bottom of block 88 to provide a working edge. The slots 86 define two narrow strips 92 that have inner projections 94, each provided with a chamfer 96 at their upper free ends. The upper part 82 consists of a bottom cylindrical portion 98 provided with two vertical slots 100 which terminate short of the bottom end of the upper part 82 to provide a stop portion 101. The outer diameter of the cylindrical portion 98 is equal to or just slightly less than the inner diameter of the cylindrical portion 84, so the two can telescope together, as seen in FIG. 3, the assembled view. To achieve this condition, the strips 92 are flexed outwardly to allow the chamfers 96 to slip by the stop portions 101 so that the projections 94 can be received in the slots 100, whereupon they are released and the portions 84 and 94 stay coupled together. A compression spring 102 is interposed between the parts 80, 82 to bias them apart.

The cylindrical part 98 defines a pair of diametrically opposite rectangular openings 110. The top of upper part 82 is a circular cap 112 having projecting diametrically opposite arms 114 that terminate in depending posts 116 each defining a rectangular opening 118 in alignment with the openings 110. A pair of fittings 120 each consisting of a rectangular plate 122 larger than opening 118 having a stud 124 projecting at right angles on one side and a rectangular block 126 projecting on the other side. Block 126 is provided with a chamfer 128. Blocks 126 are received in the openings 118 with the studs 124 facing inwardly toward each other. A compression spring 130 is received on the studs 124 and biases the plates 122 apart so that the blocks 128 normally project out of the openings 118.

Figure 11:
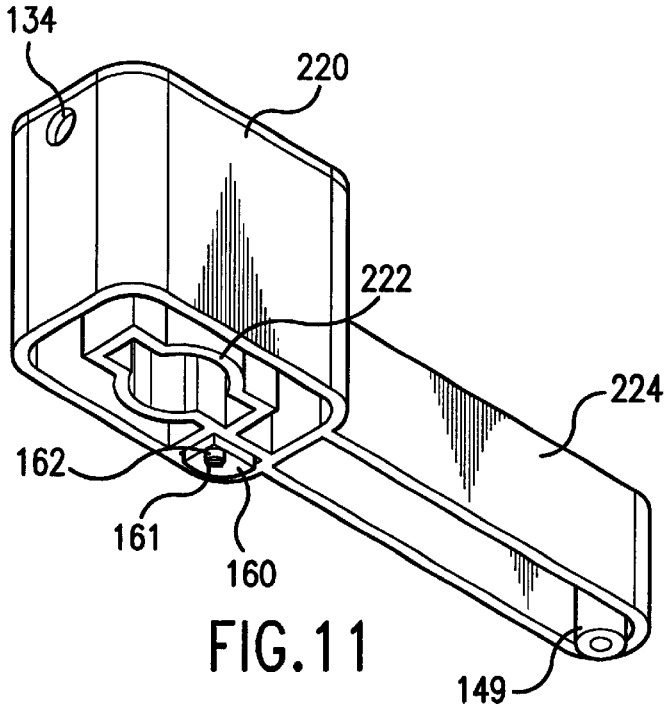
FIG. 11 is a perspective view of the squeegee in a modification of the invention.
Figure 12:
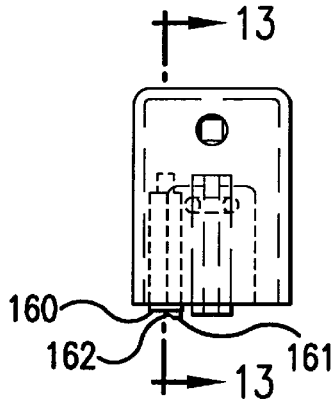
FIG. 12 is an end view of the squeegee shown in FIG. 11.
Figure 13:
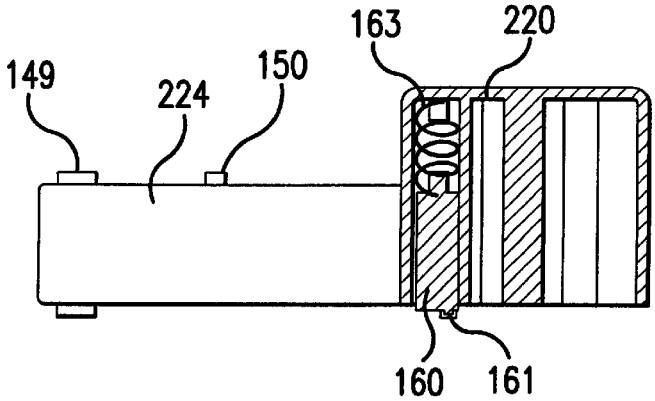
FIG. 13 is a section of FIG. 12 taken along line 13—13.
Figure 15:
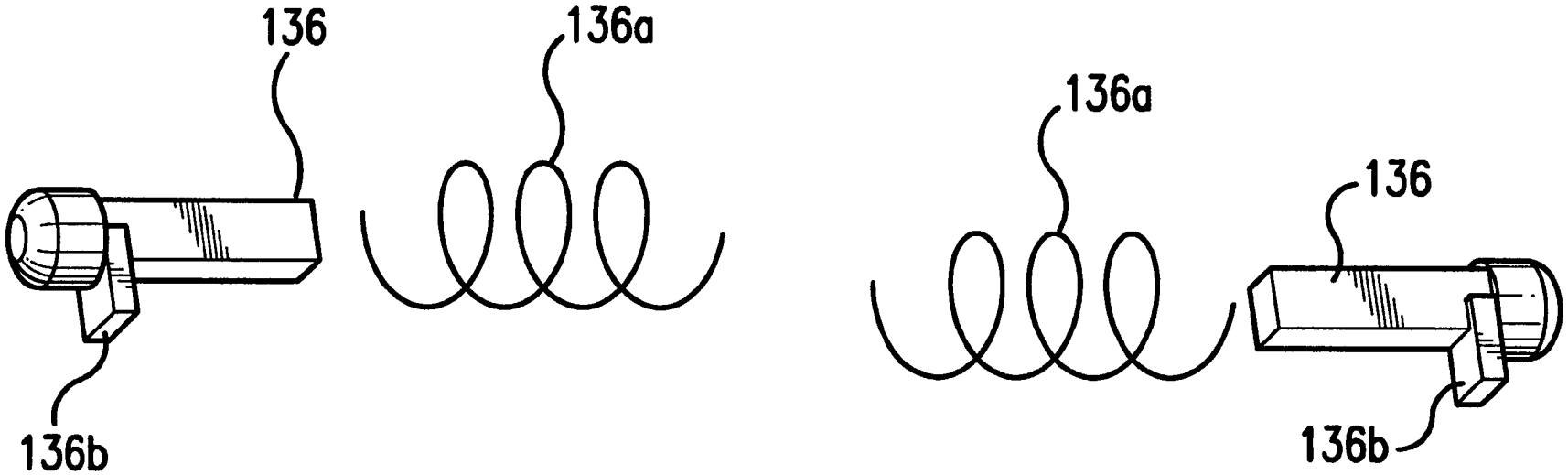
FIG. 15 is an exploded view of the push-out pins.

The housing 220 of the arm 40 is also a shell molded out of plastic provided with a vertical keyway enclosure 222 that extends from top to bottom, see FIGS. 11–13, and is dimensioned to fit the squeegee 42 so that it can be positioned in the housing 220 with the doctor blade 90 downward in an operative position, as shown in FIG. 1. At this time, the blocks 128 engage the underneath surface of the top of the housing 220 to hold the squeegee in position against the force of spring 102 and the spring 130 keep the blocks 126 forced outwardly. The housing is provided with openings 134 into which are set pins 136 spring urged outwardly for pressing against chamfers 128 and forcing blocks 126 inwardly within the openings 118 against the force of spring 130, which allows the squeegee to pop out of the slot by the force of spring 102. This action is executed when it is desired to remove the squeegee 42 for cleaning. The pins 136 and their springs **136*a* are shown in FIG. 15. The pins 136 fit in the holes 134, and are held from falling out by the tangs 136*b***.

Figure 7:
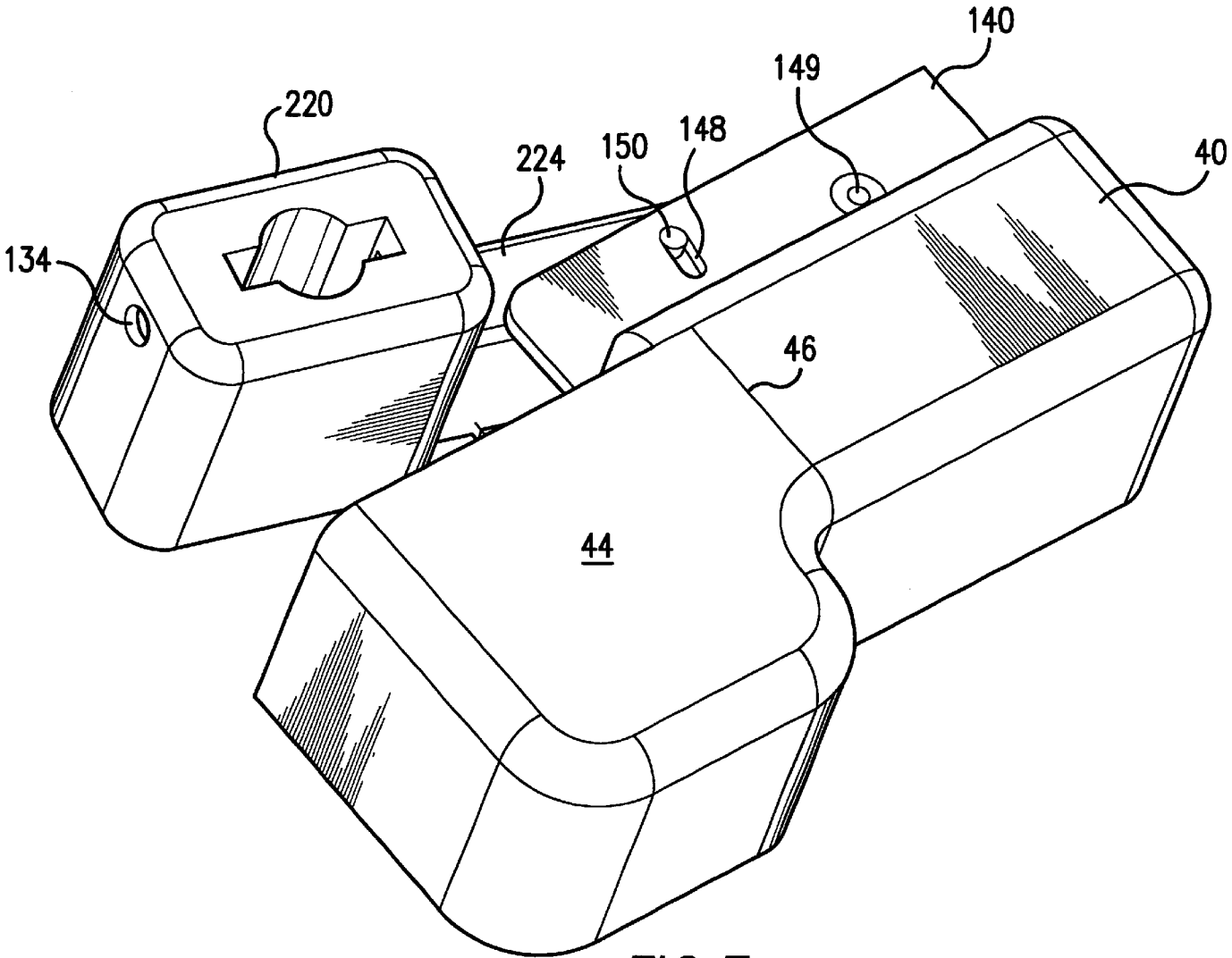
FIG. 7 is a perspective view of a modification of the pivot arm construction.

In the embodiment of FIG. 1, the housing 220 is integrally part of arm 40. FIGS. 7 and 11–13 show a modification in which the squeegee housing 220 has an integral supporting strut 224 functioning as an arm arranged to be pivotally carried by the arm 40. This modified structure is also shown in part in FIGS. 8 and 9. As shown, the shell portion 200 is molded integrally on the squeegee side, with two vertically spaced shelves 140. The squeegee housing 220, which carries the squeegee 42, is formed integrally at one end of supporting strut 224, the other end of which is pivotally mounted between the shelves 140 by pin 149. Top shelf 140 has an arcuate slot 148 into which is received a pin 150 fixed to the top of the strut 224. The pivot pin 149 is provided at the end of strut 224 for mounting in two vertically aligned holes 143 in the shelves 140. The arrangement allows the strut 224 to pivot relative to the shell of the arm 40 limited to the length of slot 148. Thus, as the arm 40 is moved to the right as shown in FIG. 7, any drag on the squeegee will force the strut 224 to the position shown in FIG. 7. When the arm 40 moves to the left as shown in FIG. 7, any drag on the squeegee will force the pin 150 to the opposite end of slot 148.

Figure 6:
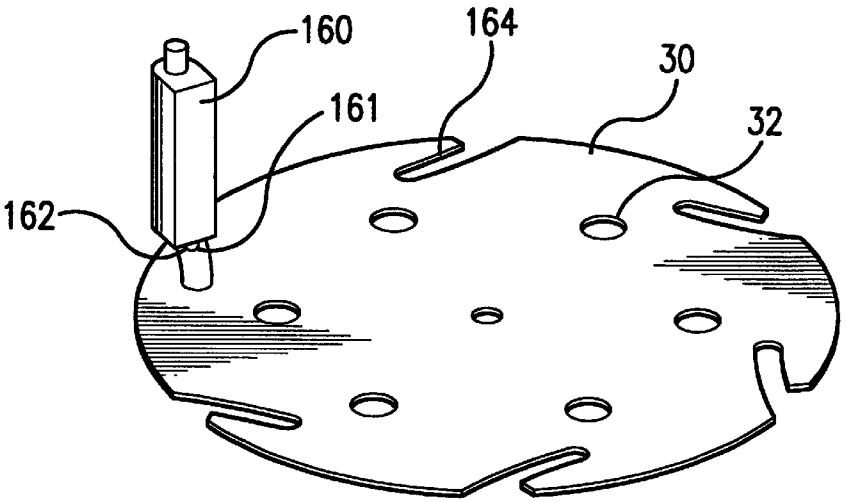
FIG. 6 is a mechanism for automatically indexing the plate during each printing cycle.

In FIG. 6 is shown a modification to cause indexing of the plate 30 automatically during each movement of the arm 40 from the plate 30 toward the deposit position at indentation 50. An inside corner of the housing 220 of arm 40, as shown in the drawing, is provided with wall structure to define a non-circular cross section to contain a spring loaded pin 160 of like cross section. The pin 160 has a bottom projection 161 having a chamfer 162 on one side. A spring 163 located between the top of pin 160 and the under surface of the housing 220 exerts a downward bias on pin 160. The plate 30 is provided with slots 164 located and orientated in juxtaposition to the image cutouts 32 such that when the squeegee completes its travel during wiping excess paint from an image, pin 160 will have traveled over the plate 30 and come to rest in the respective slot 164 associated with the operative cutout. The chamfer, along with the biased detent 54 which also engages the end of the slot 164, allows the pin 160 to move over the plate 30 without disturbing the plate. On the return movement, when the arm moves toward the deposit location, the edge of the pin 160 will engage the slot 164 and cause the plate 30 to rotate until the pin 160 is released from the slot 164 due to its changed orientation. Since there are six image cutouts shown, this will occur after a rotation of 60 degrees. In this manner, the plate 30 is automatically indexed to the next image cutout.

According to the above description, the following method is carried out. First the arm 40 is placed in a neutral position about midway between the plate 30 and position 50. A plate 30 is selected and placed in a horizontal position on an axle or in a cutout or turntable so that it can rotate about a fixed center point. The plate is indexed to locate an image cutout 32 in the appropriate position. Nail paint is placed on the plate 30 in front of the image, and the arm is rotated to squeegee the paint over the cutout image 32 and doctor the excess paint away from the cutout image 32. The print head is located over the cutout image filled with paint and the print head picks up the paint representation of the image. The arm 40 is swiveled toward the deposition location whereupon the print head makes a full revolution and deposits the paint upon a finger or toe nail. The process is repeated for different image cutouts and using different nail paint colors. Also, the plate is automatically indexed for each movement of the arm 40.

Figure 14:
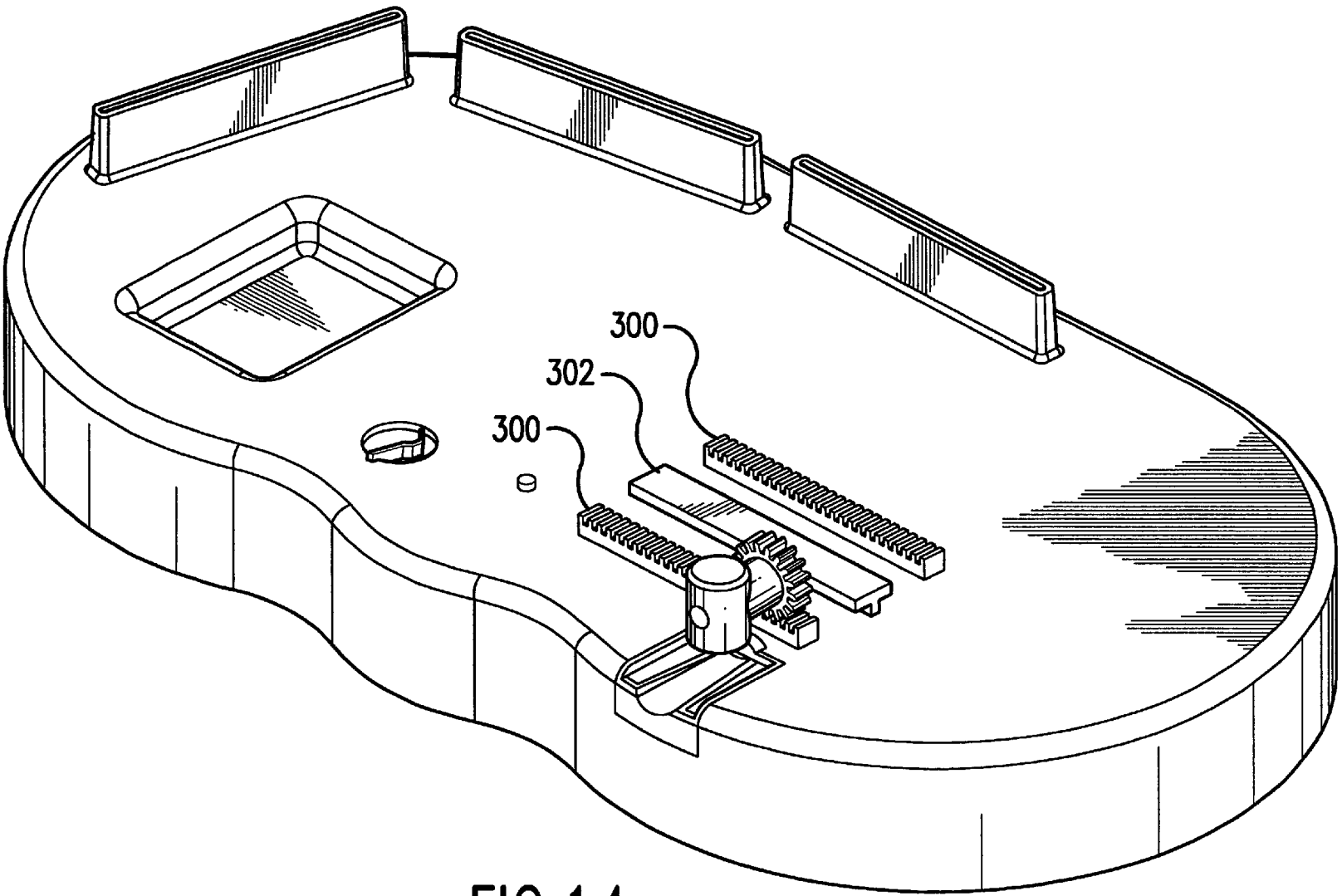
FIG. 14 is perspective view of a modified mechanism for moving the print head in a linear manner.

FIG. 14 shows a further modification of the invention. In this modification, the movement is reciprocal instead of the arcuate movement shown previously. Here, two straight racks 300 are arranged in parallel with a T-bar 302 in-between fixed to the platform 22. A carriage (not shown) is provided with a keyway matching the T-bar and is mounted on the T-bar 302 for sliding movement. The carriage is integrally molded with the split shaft 206 which fits into a recess formed on pinion gear 66 in the same manner as described previously. A second pinion gear 66 mounted on the carriage rides in the second parallel rack for balance. The arrangement is such that the print head 70 makes one revolution as it moves from the deposit location 50 to the pick-up location over the cutout image on plate 30.

Although the invention has been shown and described in terms of preferred embodiments, nevertheless changes and modifications are possible that will be evident and apparent to those skilled in the art from the disclosures herein. Such changes and modifications, which do not depart from the teachings herein, are deemed to fall within the purview of the invention as claimed.

What is claimed is:

1. Apparatus for painting nails comprising, a. a base, b. a plate mounted on said base, said plate containing a cutout for defining a positive of an image and for receiving nail paint to recreate a negative of said image, c. structure defining an image depositing location, mounted on the base spaced from the plate, d. a carrier mounted on said base for movement between a first position in juxtaposition with said plate and a second position in juxtaposition with said structure, e. a print head rotatably mounted on said carrier, f. a squeegee mounted on said carrier, and g. a mechanism cooperating with said print head to cause one revolution of rotation of the print head as it moves from the first position to the second position.

2. Apparatus according to claim 1 wherein the movement is arcuate.

3. Apparatus according to claim 1 wherein the movement is linear.

4. Apparatus according to claim 1 wherein the squeegee is removably mounted on the carrier.

5. Apparatus according to claim 1 wherein the mechanism cooperating with the print head is a rack and pinion.

6. Apparatus according to claim 1 wherein the plate contains a plurality of cutouts.

7. Apparatus according to claim 6 wherein the plate and carrier cooperate to index the plate a predetermined number of degrees for each said movement.

8. Apparatus according to claim 7 wherein said cooperation is effected by a spring loaded pin carried by the carrier and slots defined in the plate.

9. Apparatus according to claim 1 wherein the squeegee is mounted for limited pivotal movement relative to the carrier.

10. A method for applying nail paint to a finger or toe nail comprising the steps of:

a. establishing a cutout defining a positive image, b. applying nail paint to the cutout to create a negative representation of the positive image in nail paint, c. picking up the negative representation of the image in nail paint, d. transferring the picked up representation, and depositing the picked up representation onto a nail of a person with a rotating motion.

11. The method of claim 10 wherein a plurality of cutouts are provided which are used serially.

12. The method of claim 10 including the further step of doctoring the nail paint applied to the cutout.

13. The method of claim 11 including the further step of indexing the plurality of cutouts to a predetermined position relative to the picking up of the representation.

14. A method for applying nail paint to a finger or toe nail comprising the steps of:

a. creating a plate containing a plurality of cutouts each defining a positive image, b. locating the plate with one of the plurality of cutouts in a selected position, c. applying nail paint to the cutout in the selected position to create a negative representation of the negative image in nail paint, d. picking up the representation of the image in nail paint by a print head having a pick-up pad in a vertical position, e. transferring the picked up representation while rotating the print head through one revolution, and depositing the picked up, rotated representation onto a nail of a person with the print head in a vertical position.

15. The method of claim 14 wherein the plate is indexed to a different cutout following transfer of the picked up representation.

16. The method of claim 14 wherein the applied nail paint is doctored to remove excess paint.

17. Apparatus for painting nails comprising, a. a base, b. a plate mounted on said base, said plate containing a cutout for defining a positive of an image and for receiving nail paint to recreate a negative of said image, c. structure defining an image depositing location, mounted on the base spaced from the plate, d. a carrier mounted on said base for movement between a first position in juxtaposition with said plate and a second position in juxtaposition with said structure, e. a print head rotatably mounted on said carrier, f. a squeegee mounted on said carrier, and g. a mechanism cooperating with said print head to cause rotation of the print head as it moves into at least one of the first position and the second position.

* * * * *